United States Patent [19]

Lapeyre

[11] 4,199,040

[45] Apr. 22, 1980

[54] SHIP LADDER

[75] Inventor: James M. Lapeyre, New Orleans, La.

[73] Assignee: The Laitram Corporation, New Orleans, La.

[21] Appl. No.: 5,285

[22] Filed: Jan. 22, 1979

[51] Int. Cl.[2] ..... E06C 9/02; B63B 29/20

[52] U.S. Cl. ..... 182/93; 182/106; 182/189; 182/194; 182/228

[58] Field of Search ..... 182/93, 194, 100, 189, 182/106, 228; 52/182, 187, 191

[56] References Cited

U.S. PATENT DOCUMENTS

| | | | |
|---|---|---|---|
| 234,389 | 11/1880 | Cannon | 182/189 |
| 858,199 | 6/1907 | Modjeski | 182/194 |
| 2,641,401 | 6/1953 | James | 182/189 |
| 3,310,132 | 3/1967 | Rolland | 182/189 |
| 3,467,220 | 9/1969 | Smith | 52/182 |
| 4,061,202 | 12/1977 | Campbell | 182/100 |
| 4,069,892 | 1/1978 | Lynne | 182/189 |
| 4,125,175 | 11/1978 | Ernst | 182/228 |

*Primary Examiner*—Reinaldo P. Machado
*Attorney, Agent, or Firm*—Weingarten, Maxham & Schurgin

[57] ABSTRACT

A ladder is provided which is especially adapted for shipboard use and which is safe and comfortable to use, of relatively light weight and occupying relatively small floor and overhead space. The ladder comprises a single stringer disposed between upper and lower deck or floor levels at a predetermined angle of inclination, and having an array of half treads on each side of the stringer, each array being vertically spaced from the other along the length of the stringer. The half treads are affixed to and extend from the respective sides of the stringer and each include an integral outwardly extending portion which terminates in a plane forward of a plane passing through the front edges of the treads. Handrails are disposed in this forward plane and are affixed to and supported by the outwardly extending tread portions.

19 Claims, 28 Drawing Figures

SHIP LADDER

FIELD OF THE INVENTION

This invention relates to ladders and more particularly to a ladder especially adapted for use aboard a ship.

BACKGROUND OF THE INVENTION

In ship construction, space and weight are important and often critical factors which must be taken into account in the engineering design of the vessel and all apertinent structures. Ladders presently employed aboard ship are constructed in conventional manner with treads of sufficient width to accommodate both feet of a user standing upon the tread, the treads being supported by two or more stringers extending between the upper and lower levels interconnected by the ladder way. In ascending or descending a ladder, the right foot of a user steps upon the right hand portion of a first tread and the left foot steps upon the left hand portion of a second tread. Thus, alternate treads are employed by each foot of the user and it is not usually necessary to stand upon a single tread with both feet during ascent or descent of a ladder. The presence of a full width tread in conventional ship ladders, only half of the tread being used, is wasteful of material and adds to the weight of the ladder structure. The presence of a full width tread also presents an obstacle to the movement of a user's foot in ascending or descending the ladder creating an unnecessary safety hazard for the user. The inclination of a conventional ladder must be such that a user can move his foot past the unused portion of a tread in moving to the next tread of the ladder, thus limiting the angle of inclination.

Ladders are known in which treads or rungs are alternately arranged along a single stringer or pole. In ascending and descending ladder of this known type, a user must face the ladder and support himself by holding on to the rungs to guide his ascent or descent. Such ladders of known construction cannot be descended facing forward, as with a stairway. These known ladders also require a fair degree of dexterity on the part of a user and are not very comfortable to use.

SUMMARY OF THE INVENTION

In accordance with the present invention, a ladder is provided which is especially adapted to shipboard use and which is safe and comfortable to use, of relatively light weight and which occupies relatively small floor and overhead space. The novel ladder can be of relatively inexpensive construction, and the particular structural implementation can vary to suit the installation requirements whether aboard a ship or other vessel or facility. The novel ladder comprises a single stringer or central tread support disposed between upper and lower deck or floor levels at a predetermined angle of inclination, and having an array of half treads on each side of the stringer, each array being vertically spaced from the other along the length of the stringer. The half treads are affixed to and laterally extending from the respective sides of the stringer and each includes an integral outwardly extending portion which terminates in a plane which is forward of a plane passing through the front edges of the treads. First and second handrails are disposed in this forward plane and are affixed to and supported by the outwardly extending tread portions.

The novel ladder can be disposed at a relatively steep angle in comparison to a conventional ladder of the same tread width and riser height and provides sufficient safety and comfort to permit balanced use of the ladder even without holding on to the handrails. The treads can be of sufficient size to allow normal outward angling of the feet in using the ladder such that the ladder can be ascended and descended easily without any special care or technique in its use.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
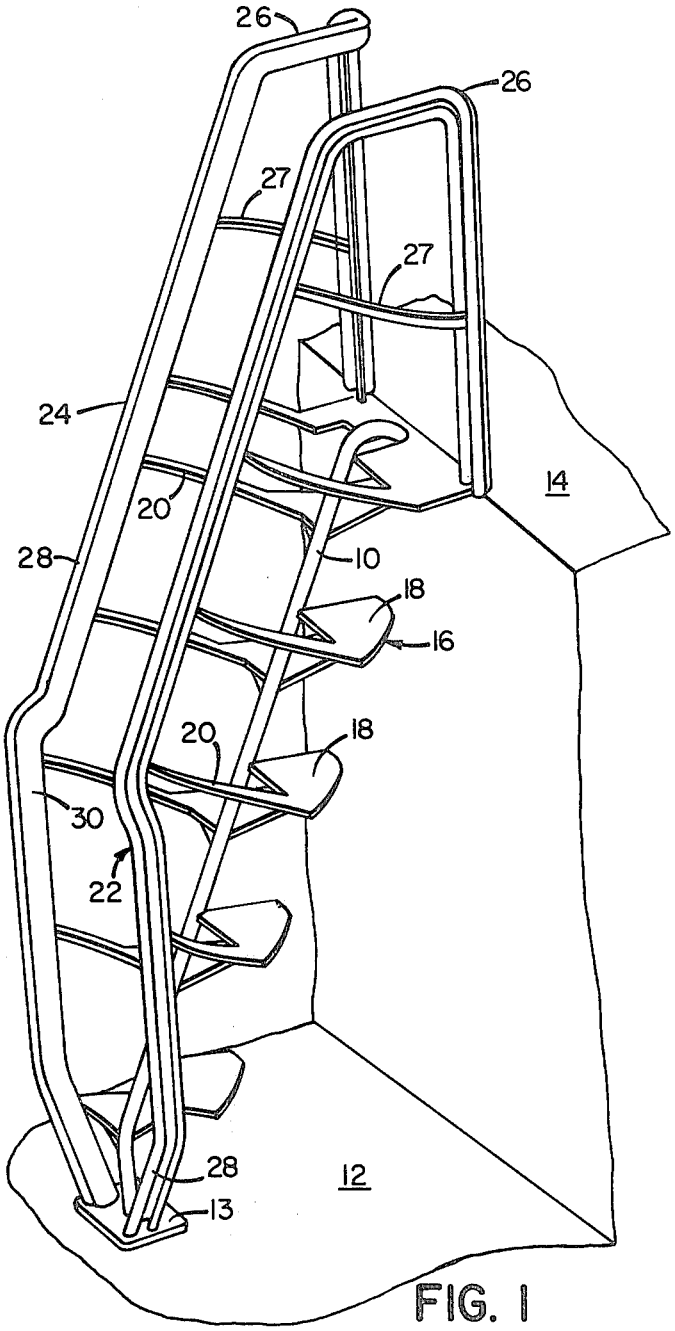
FIG. 1 is a pictorial view of a preferred embodiment of the novel ladder.
Figure 2:
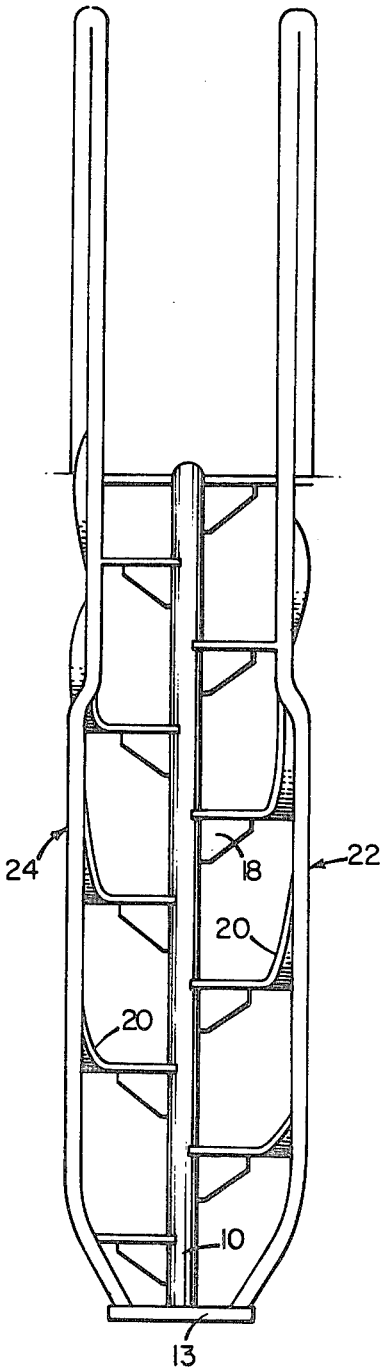
FIG. 2 is a front view of the embodiment of FIG. 1.
Figure 3:
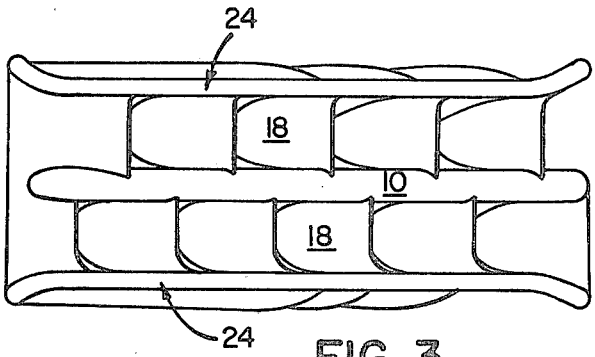
FIG. 3 is a top view of the embodiment of FIG. 1.

Referring to the drawing and particularly FIGS. 1–3, there is shown a preferred embodiment of the novel ladder which comprises a single stringer or central tread support 10 disposed between a lower deck 12 and an upper deck or platform 14. A mounting plate 13 can be provided to secure the lower end of stringer 10 to deck 12. A plurality of treads 16 and alternately disposed on respective sides of the stringer 10 and are equally spaced along the length thereof. Each of the treads 16 includes a laterally extending portion 18 adjacent to the stringer adapted and configured to accommodate the foot of a person ascending or descending the ladder. Each tread also includes an outwardly extending portion 20 which is affixed to a handrail. First and second handrails 22 and 24 are provided, each on a respective side of the stringer 10 and each joined to the portions 20 of the array of treads on the respective side. In the illustrated embodiment, the handrails are bent downwardly and fastened at their lower ends 26 to the plate 13 to minimize floor space, and are formed into railings 26 at their upper ends. Bracing struts 27 can be provided for the railings 26. The entire ladder structure is thus composed of a single stringer, alternating series of half treads and a pair of handrails to form an open frame structure requiring no additional bracing. The handrails are positioned at a convenient distance forward of the treads so that a person using the ladder will feel secure in its use. The ladder can be ascended facing forward and can be descended facing outward from the ladder, as in descending a conventional stairway, rather than the rearward descent on a rung-type ladder.

The novel ladder has several major benefits especially for use aboard a ship. The ladder is safe, comfortable to use, and eliminates the portion of a conventional full width tread which can interfere or become an obstacle as the foot of a user ascends or descends to the next step. Construction of the ladder permits relatively simple and inexpensive assembly and a resulting structure which can be of less weight than conventional structures. In addition, the ladder employs less floor space and overhead space to accommodate its horizontal run since it is more steeply inclined than a conventional ladder providing the same degree of comfort and safety. To accommodate the usual range of adult sizes, the tread width (side to side extension) typically can be about 5–8 inches, the length of the tread (fore and aft extension) can be about 4–11 inches, and the riser height between adjacent treads can be about 6–12 inches. An odd number of half treads can be employed on each side of the stringer so that a person can ascent and descend the ladder beginning and ending with the same foot.

Figure 4:
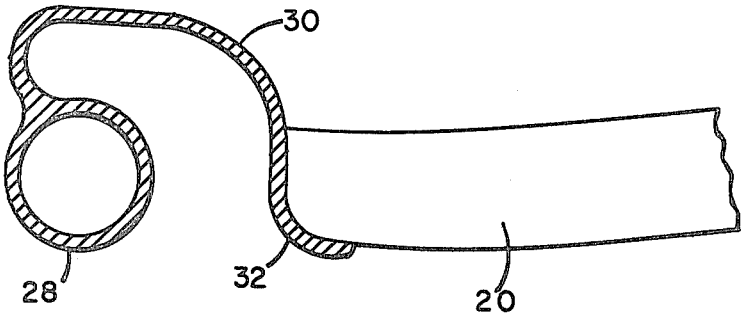
FIG. 4 is a cross sectional view of the extruded handrail employed in the embodiment of FIGS. 1 through 3.

In the embodiment of FIGS. 1–3, the stringer 10 is of tubular form and to which the treads 16 are affixed such as by welding. The handrails 22 and 24 are formed of an extruded member illustrated in cross section in FIG. 4. As seen in FIG. 4, the extruded handrail includes a tubular grip portion 28 and a partially surrounding web portion 30, the outer end 32 of which is of thicker cross section. The outer ends of tread portions 20 are welded or otherwise affixed to the web end 32. In the illustrated embodiment the tread portions 20 are angularly disposed upward with respect to portions 18 and are affixed to the associated handrails 22 and 24 at approximate right angles thereto. The web portion 30 of the extruded rails serves as a body guide when employing the ladder since this web provides a smooth continuous surface confronting the user's body. In this embodiment, the tread extension portions 20 are curved to define a generally U-shaped passage in which a user ascends and descends the ladder.

Figure 5:
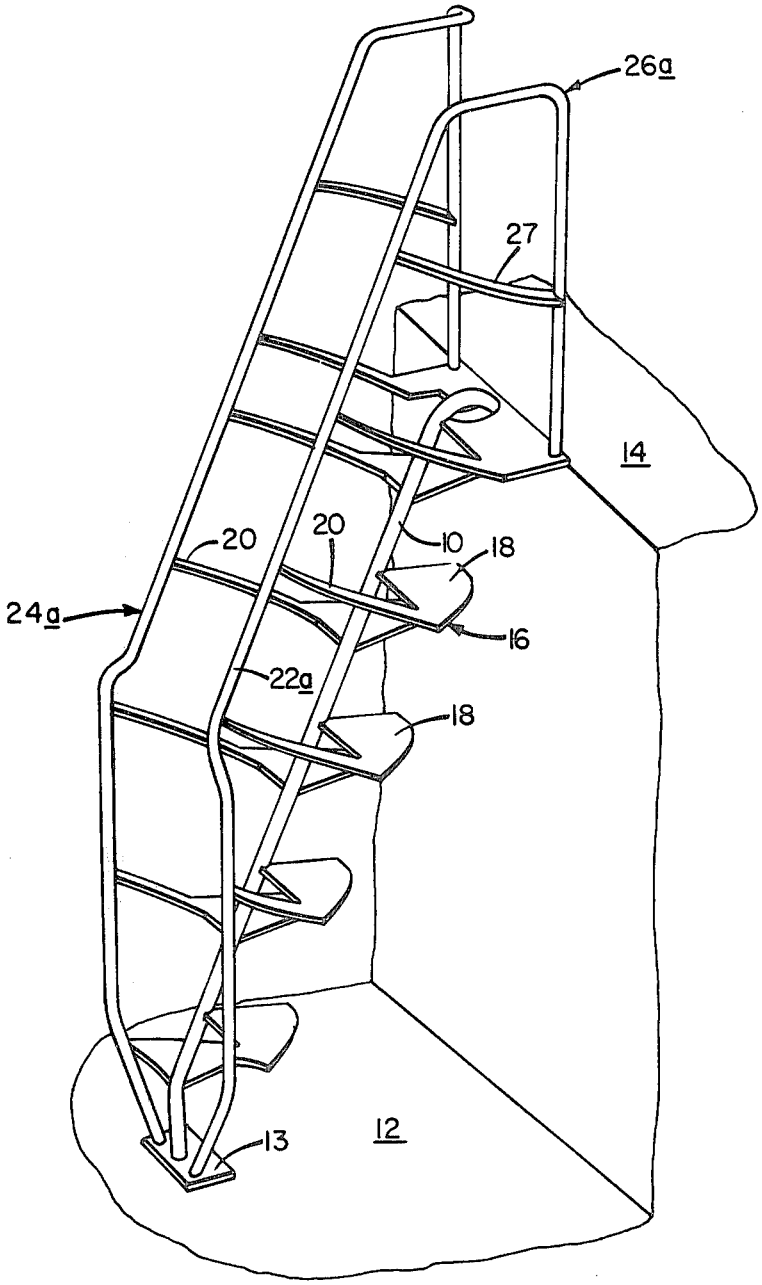
FIG. 5 is a pictorial view of an alternative embodiment of the invention.

A variation of the embodiment described above is illustrated in FIG. 5 and differs therefrom by the handrails 22*a* and 24*a* which are of tubular configuration. These handrails 22*a* and 24*a* can be fabricated from standard tube stock and formed into the intended shape and welded or otherwise affixed to the tread extension portions 20 and upper and lower mounting surfaces.

Figure 6:
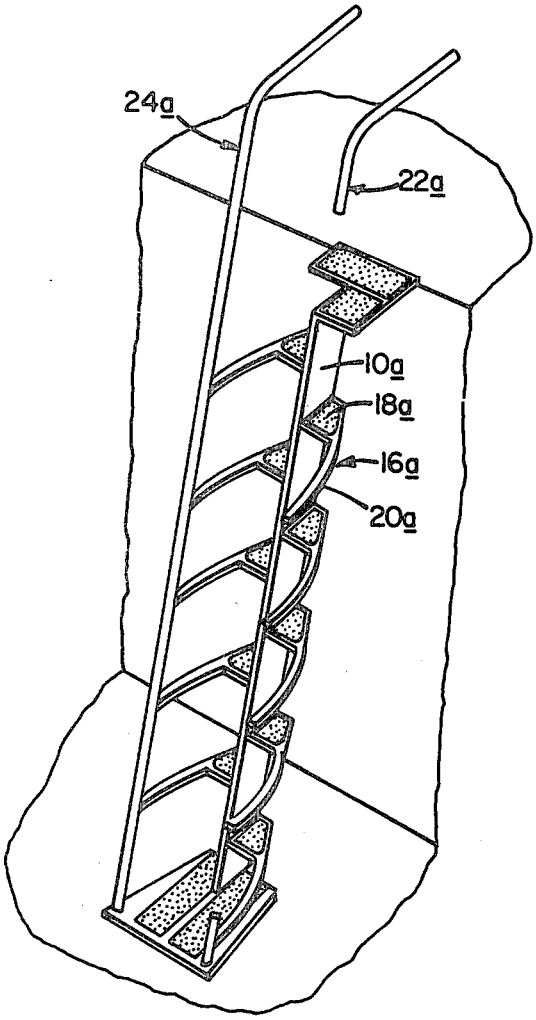
FIG. 6 is a pictorial view of a further embodiment of the invention.
Figure 7:
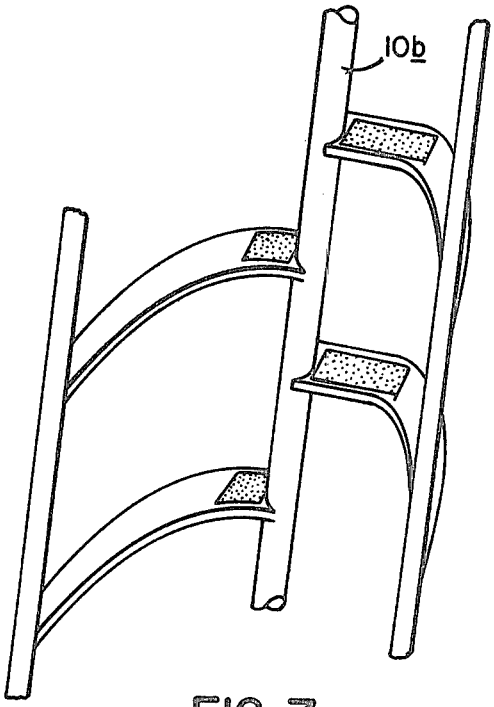
FIG. 7 is a cutaway pictorial view of a variation of the embodiment of FIG. 6.

A further embodiment is shown in FIG. 6 which includes a rectangular stringer member 10*a* and treads 16*a* which include foot receiving portions 18*a* and outwardly extending portions 20*a* which lie in the same plane as the associated portions 18*a*. The handrails 22*a* and 24*a* are of tubular construction. The stringer can of course also be of tubular configuration as illustrated at 10*b* in FIG. 7. The tubular construction offers lower resistance to wind and waves aboard ship and is often preferable.

Figure 8:
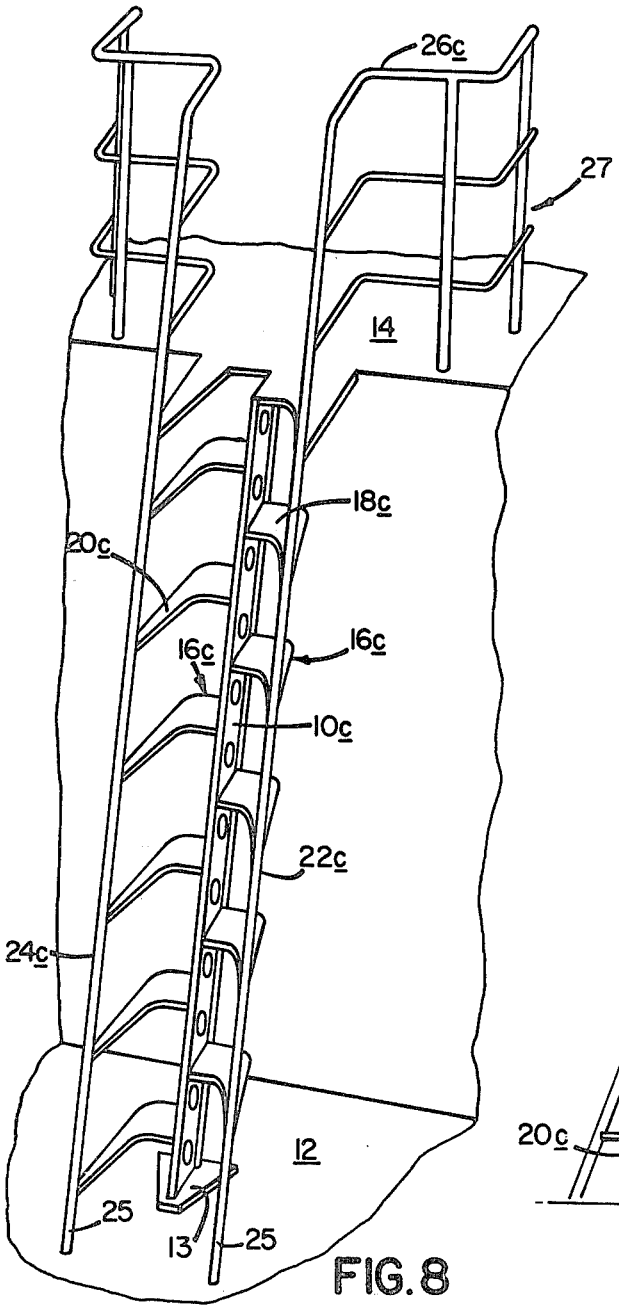
FIG. 8 is a pictorial view of yet another embodiment of the invention.
Figure 9:
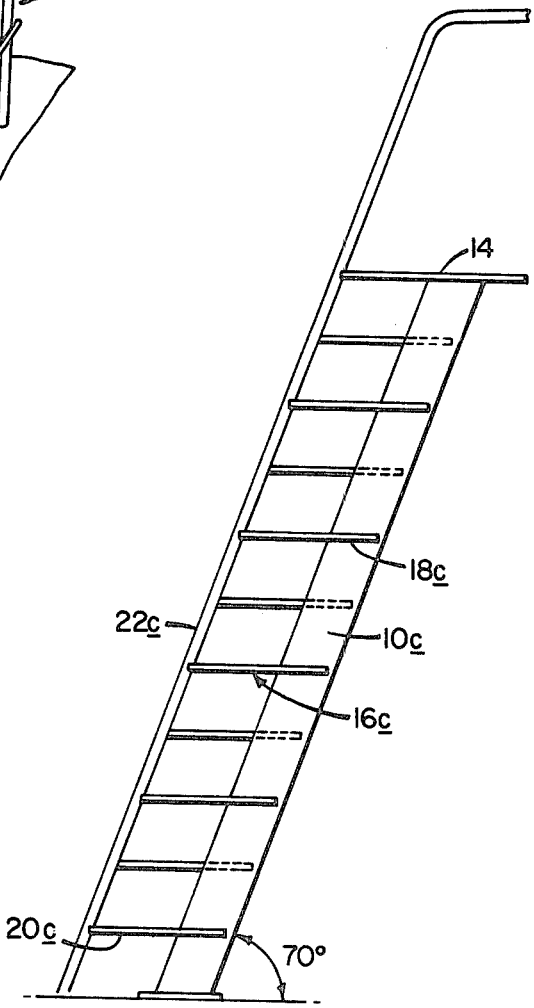
FIG. 9 is a side view of the embodiment of FIG. 8.
Figure 10:
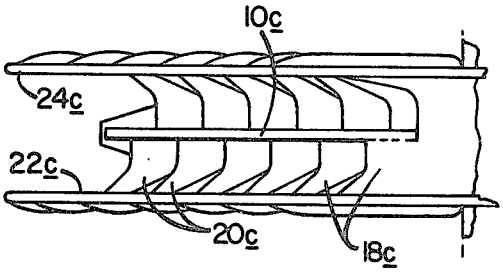
FIG. 10 is a top view of the embodiment of FIG. 8.

A further variation of construction is shown in FIGS. 8–10. Here the tubular railings 22*c* and 24*c* extend in a linear path along the full length of the ladder, as in FIG. 6 above, and are formed into or join an upper railing 26*c* to which is affixed an associated frame structure 27. The stringer 10*c* is formed of a structural T-member having openings provided along the length thereof to eliminate unnecessary material and reduce the weight of the structure. The treads 16*c* are each of planar form in this embodiment.

Figure 11:
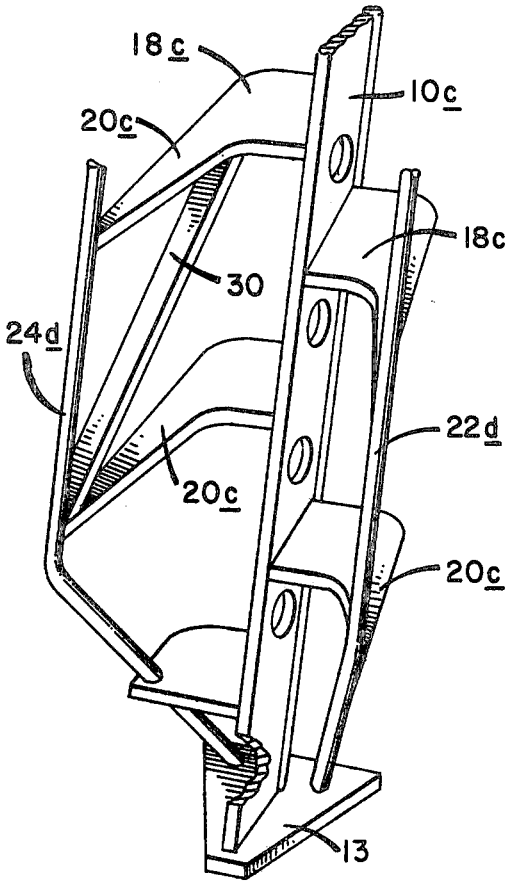
FIG. 11 is a cutaway pictorial view of a further alternative construction of the novel ladder.
Figure 12:
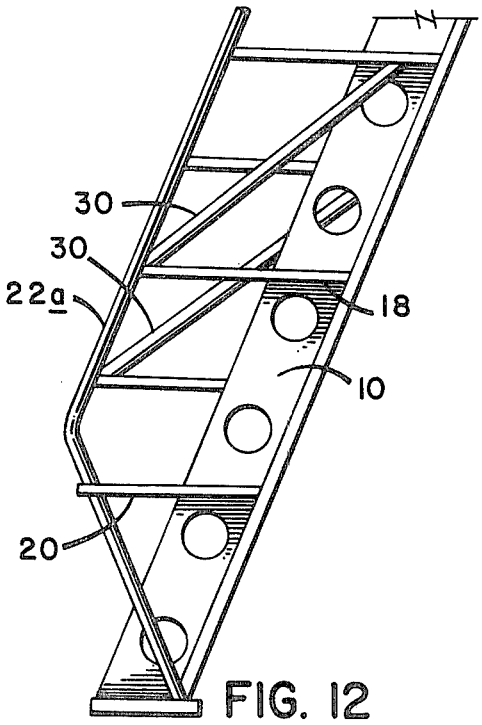
FIG. 12 is a cutaway side view of the embodiment of FIG. 11.

An alternative construction is shown in FIGS. 11 and 12 in which a bracing strut 30 is disposed between the junction of tread portion 20*c* and the associated handrail, and the portion of the stringer 10*c* adjacent to the tread portion 18*c*. This embodiment also shows each handrail 22*c* and 24*c* bent near the lower end thereof to a rearward disposition and attached near the bottom end of the stringer such as to plate 13.

Figure 13:
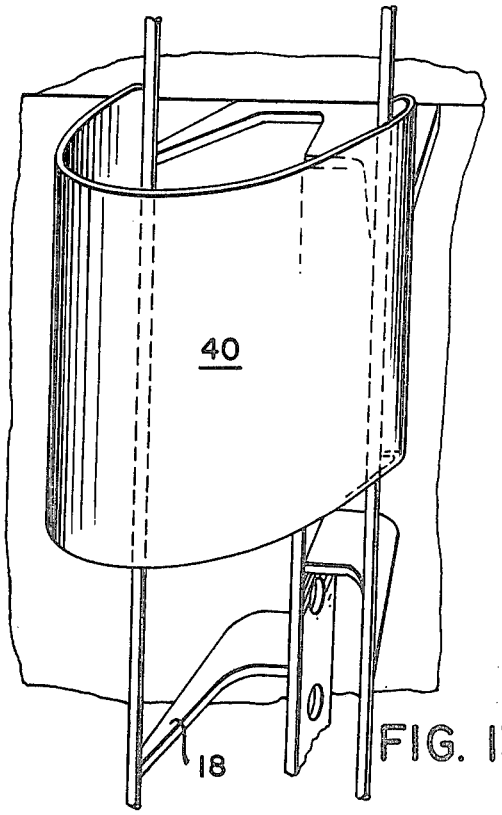
FIG. 13 shows a body encircling shield which can be employed in the present invention.

In instances where the ladder is employed in positions exposed to high wind, or other environmental factors, or where fire codes safety may require, the ladder can be provided with the full or partial enclosure as shown in FIG. 13. The enclosure 40 can be of any suitable material and of either sheet or framework construction affixed to the outer portions of the treads. The enclosure should be attached to the ladder in such a manner to not interfere with use of the handrails.

Figure 14:
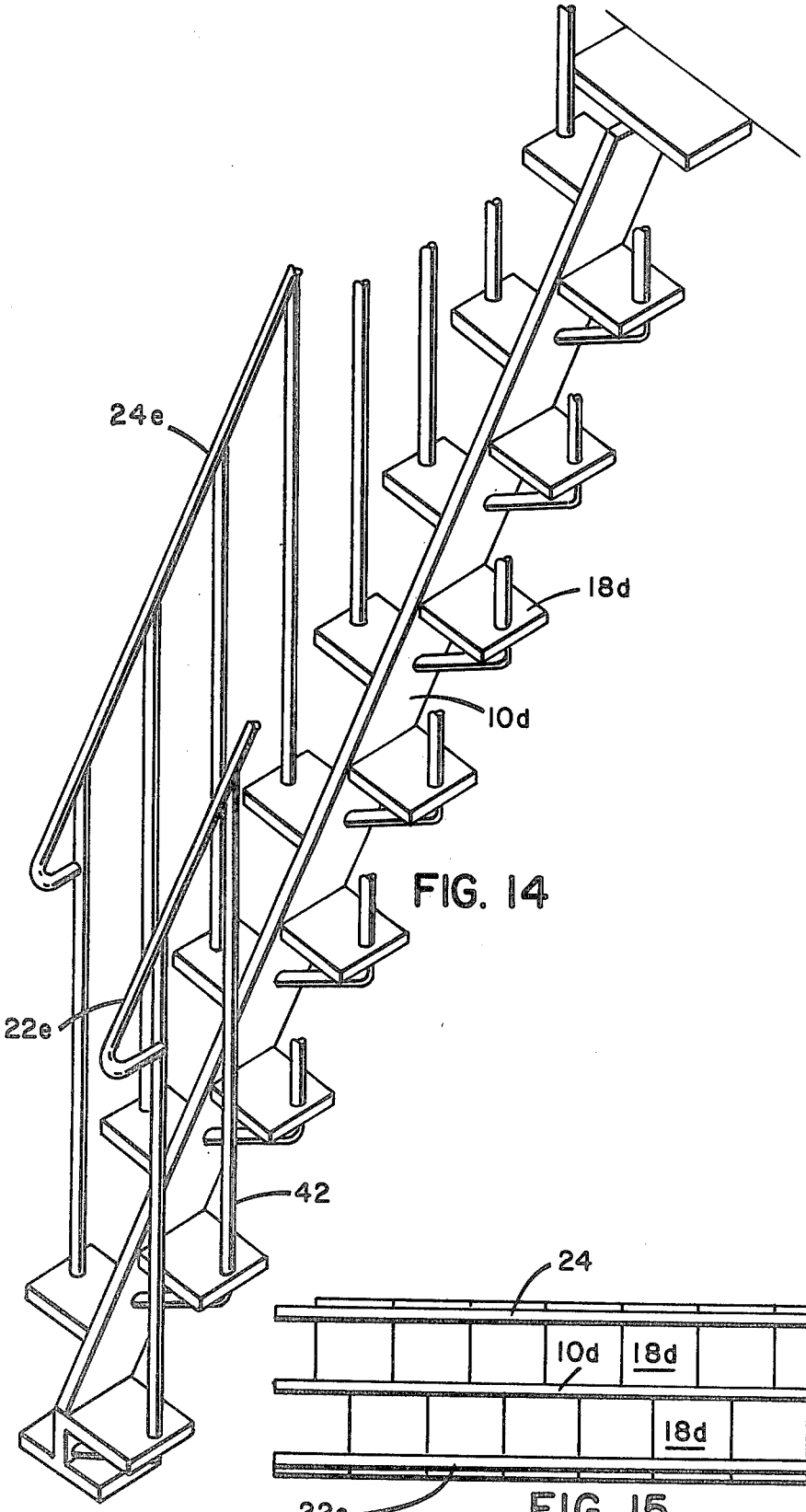
FIG. 14 is a partly cutaway pictorial view of another embodiment of the invention.
Figure 15:
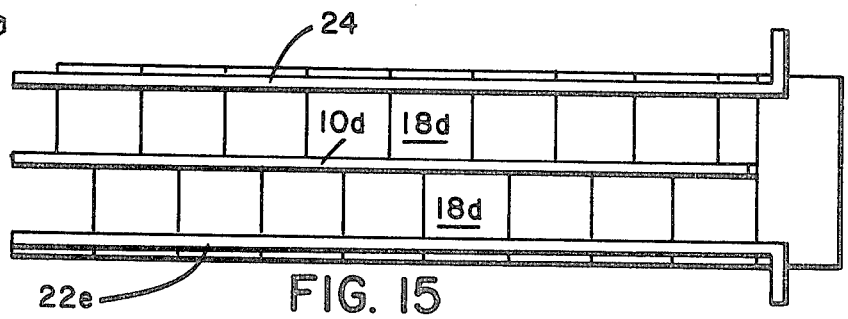
FIG. 15 is a top view of the embodiment of FIG. 14.

A further embodiment is depicted in FIGS. 14 and 15. A stringer 10*d* has affixed thereto alternating arrays of treads 18*d*. Tubular handrails 22*e* and 24*e* are provided and affixed to the associated arrays of treads by vertical members 42 each affixed at its upper end to an associated handrail, and at its lower end to a respective tread 18*d*. Each member 42 passes through an opening in the associated tread and inwardly extends into engagement with the stringer 10*d*.

The novel ladder can be employed in pairs arranged side by side to provide separate ladder ways for two-way traffic. Any of the embodiments described herein can be so arranged; typically, the adjacent handrails of the two ladders are spaced sufficiently so that users passing each other on the two ladders each retain use of their respective handrails.

Figure 16:
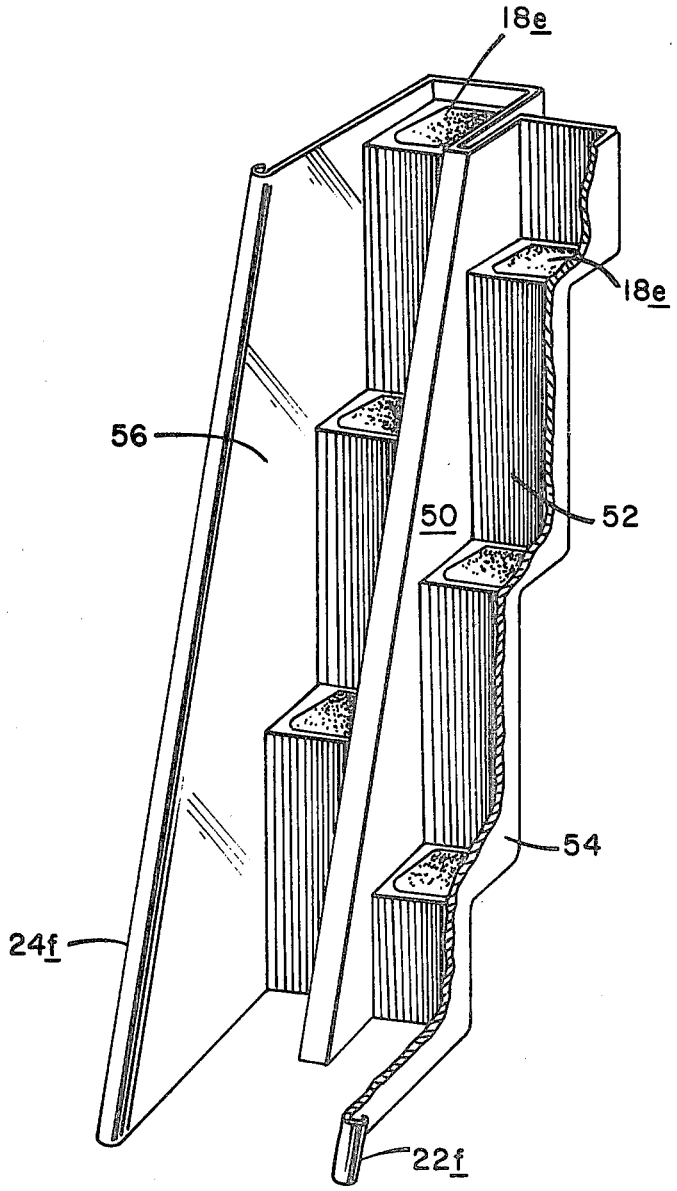
FIG. 16 is a partly cutaway pictorial view of the invention as embodied in an integrally molded structure.

The invention can also be fabricated in integral molded form as shown in FIG. 16. In this embodiment the ladder is constructed of fiberglass or other appropriate material which can be molded in unitary form or otherwise fabricated to yield a unitary structure. This structure includes a central wall 50 which serves as the single stringer member. Alternating arrays of half treads 18*e* are integrally formed in respective arrays on opposite sides of wall 50, each half tread being integrally attached to its adjacent half treads by riser portions 52. Outer walls 54 and 56 are integrally formed with riser portions 52 and half treads 18*e* and terminate at their forward edges in handrails 22*f* and 24*f*.

Figure 18:
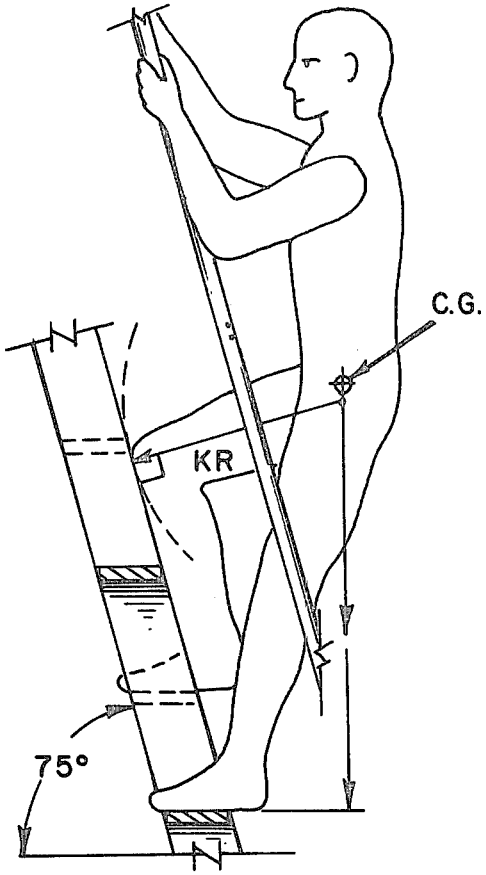
Figure 19:
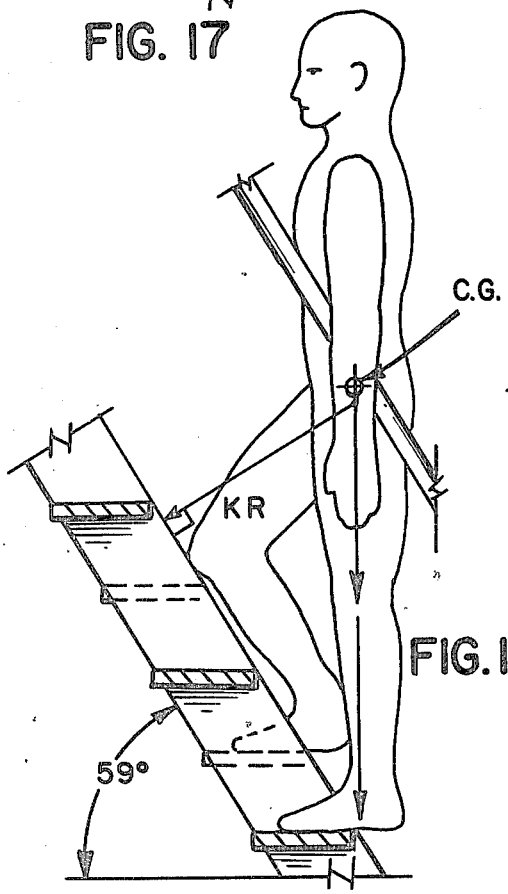
Figure 20:
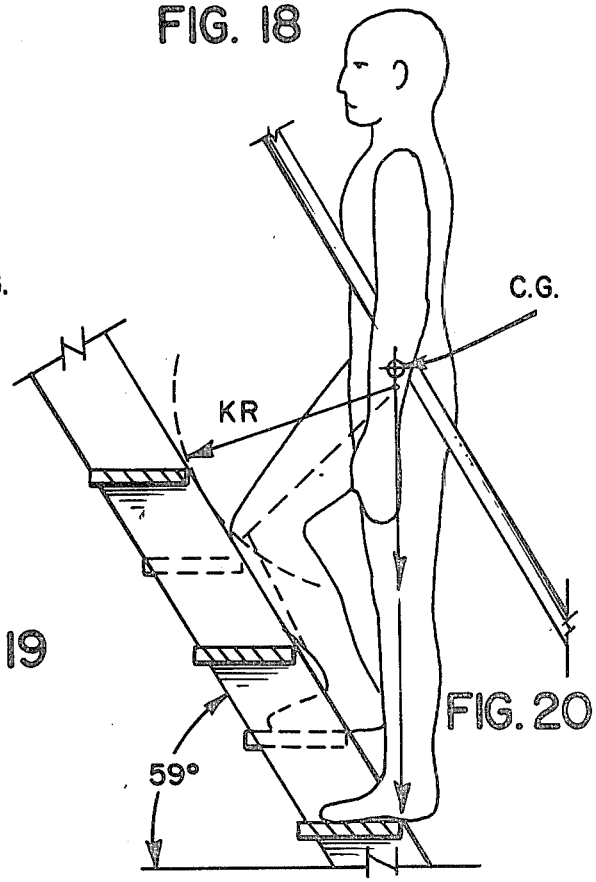

The ladder can be disposed at a relatively steep angle and still provide safe and comfortable use. For angles up to about 59° as measured from the horizontal, the ladder can be used without hands and with the user remaining balanced on the treads, as illustrated in FIGS. 19 and 20. This maximum angular disposition is based upon known human engineering data from which it has been determined that the ratio of the knee radius to the hip pivot height of individuals is nearly constant for both men and women of usual size range. This constant factor turns out to be about 0.516 and from which the 59° maximum angle can be computed. For angles greater than about 59°, a person must bend at the hips and tilt the straight leg rearward in order to have knee clearance when ascending the ladder, as shown in FIG. 18. The ladder can be steeper than a conventional ladder of the same tread width and riser height since the half tread construction avoids interference of a user's feet, legs and knees in moving up or down the ladder.

Figure 17:
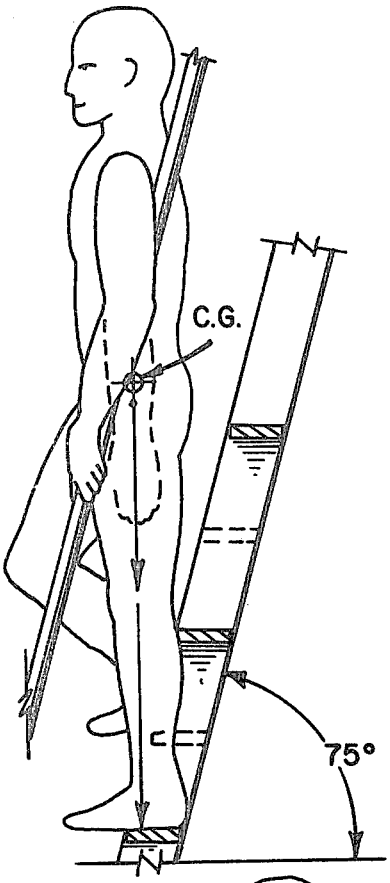
FIGS. 17–20 illustrate use of the novel ladder.
Figure 21:
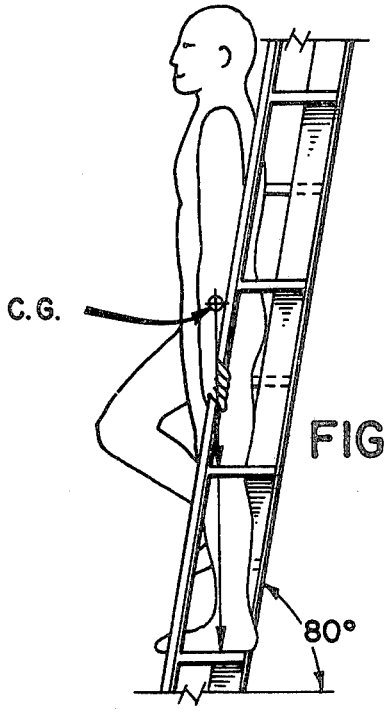
FIGS. 21–28 provide further illustration of usage of the novel ladder.
Figure 22:
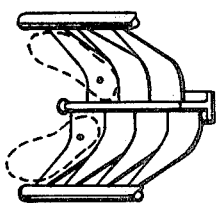
Figure 23:
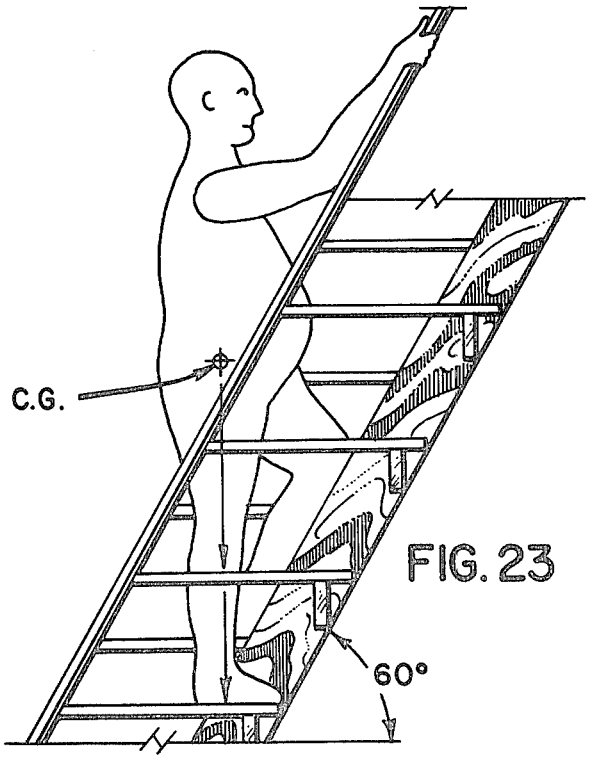
Figure 24:
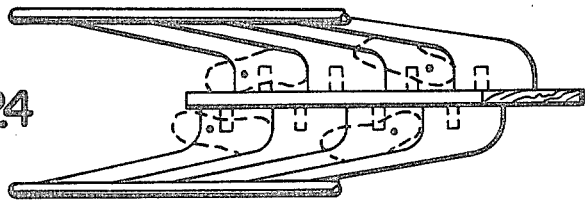
Figure 25:
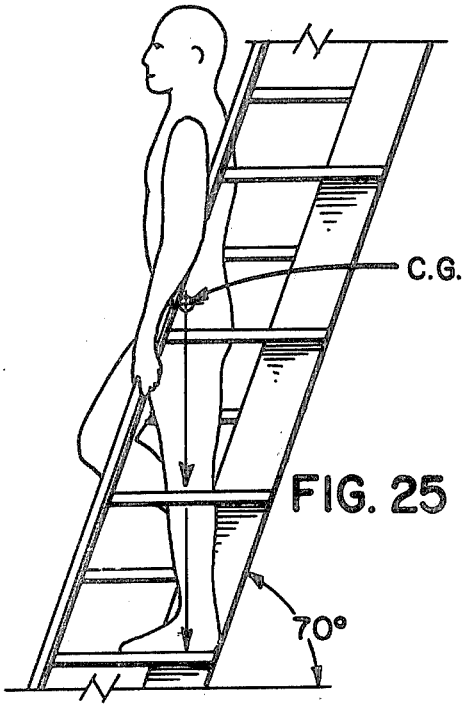
Figure 26:
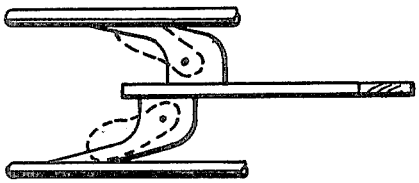
Figure 27:
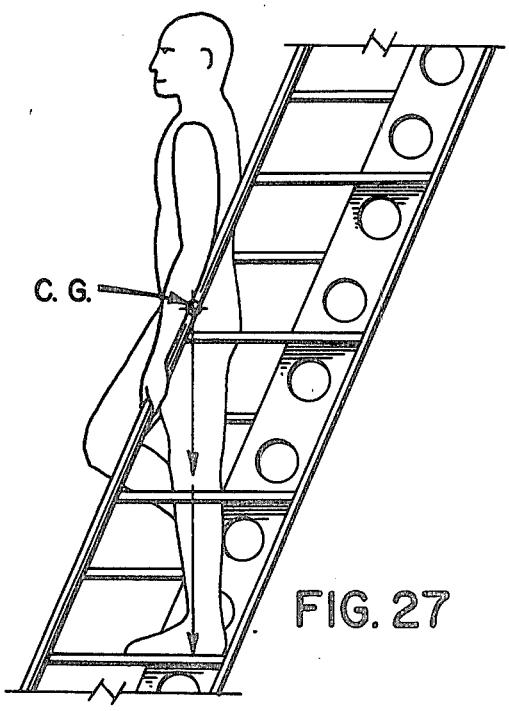
Figure 28:
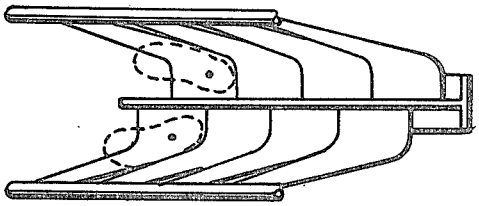

For safest use aboard ship the rails are preferably at a height to lie under the arms of a user while descending upon the ladder, as shown in FIGS. 17 and 25. On the rails can lie just below the arms of a user, as in FIGS. 21 and 27. The rails thus serve as further support and as a guide in walking down the ladder while facing forward. The treads may be of sufficient size and configuration to permit the normal outward angling of a user's feet, as shown in FIGS. 22, 24, 26 and 28, and in descent of the ladder, the feet are seen to extend over the tread itself and a portion of the tread support.

It should be noted that the center of gravity (C.G.) shown in the drawings are for illustrative purposes and are approximately correct for the human figure standing upright. The actual C.G. shifts with movement of the legs, arms and torso.

The invention is not to be limited by what has been particularly shown and described except as indicated in the appended claims.

What is claimed is:

1. A ladder comprising:

a single central tread support member adapted for mounting between an upper level and a lower level at a predetermined angle of inclination;

a plurality of tread members disposed in alternating arrangement on respective sides of said support member, each of said tread members having a foot support portion outwardly extending from said support member, and each of said tread members having rail support means outwardly extending from the foot support portion and terminating substantially in a plane forward and parallel to a plane passing through the front edges of the foot support portions; and first and second handrails each attached to said rail support means.

2. The ladder of claim 1 wherein said predetermined angle is greater than 50°.

3. The ladder of claim 1 wherein the rail support means are substantially coplanar with said foot support means.

4. The ladder of claim 1 wherein the rail support means are curved inwardly of the ladder.

5. The ladder of claim 1 wherein the rail support means are integral with said foot support means.

6. The ladder of claim 1 wherein said handrails each are extrusions having a hand gripping portion, a web portion and an attachment portion.

7. The ladder of claim 1 wherein said handrails are positioned to provide support to the sides of the user's body.

8. The ladder of claim 1 wherein said central tread support member, said tread members, and said rail support members are integrally molded in a one piece construction.

9. The ladder of claim 8 wherein said handrails are included in said one piece construction.

10. A ladder comprising:

a single stringer adapted for mounting at a predetermined angle of inclination between a lower mounting surface and an upper mounting surface;

a first array of tread members each attached to one side of the stringer and spaced along the length thereof;

a second array of tread members each attached to the opposite side of the stringer and spaced along the length thereof at a position spaced from adjacent tread members of the first array;

each of said tread members including:

a foot support portion adjacent the stringer and adapted to accommodate a foot of a user, and an outwardly extending portion which terminates in a plane which is forward of a plane passing through the front edges of the foot support portions; and first and second handrails each disposed on a respective side of the stringer and attached to the outward ends of the respective arrays of tread members and lying in the forward plane.

11. The ladder of claim 1 wherein said tread members are each of integral construction with said outwardly extending portion being an integral extension of said tread portion.

12. The ladder of claim 1 wherein said stringer, plurality of tread members and handrails are of integral unitary construction.

13. The ladder of claim 1 wherein said handrails each include a generally tubular portion providing a hand gripping surface and a spaced web portion affixed to the forward ends of the respective array of tread members.

14. The ladder of claim 1 wherein said stringer is of tubular configuration.

15. The ladder of claim 14 wherein said handrails are each of tubular configuration.

16. The ladder of claim 1 wherein said handrails each include a linear section extending substantially along the arrays of tread members, and a lower section extending inwardly from said linear section and having a lower end affixed to the lower mounting surface beneath the lower tread portions.

17. The ladder of claim 10 wherein said stringer is tubular and wherein said tread members each include an outwardly extending portion which is integral with the foot support portion and which is angularly disposed relative to the foot support portion and joined to a handrail approximately at a right angle thereto.

18. The ladder of claim 10 wherein the outwardly extending portions of said first and second arrays of tread members are curved to define a body encircling channel for a user.

19. The ladder of claim 10 including a shield outwardly extending from the handrails along at least a portion of the length of the ladder and adapted to encircle a user on the ladder.

* * * * *

UNITED STATES PATENT AND TRADEMARK OFFICE

CERTIFICATE OF CORRECTION

PATENT NO. : 4,199,040
DATED : April 22, 1980
INVENTOR(S) : James M. Lapeyre

It is certified that error appears in the above—identified patent and that said Letters Patent is hereby corrected as shown below:

Column 6, line 26, change "1" to --10--.
line 30, change "1" to --10--.
line 33, change "1" to --10--.
line 37, change "1" to --10--.
line 41, change "1" to --10--.

Signed and Sealed this
*Fifteenth* Day of *March 1983*

[SEAL]

*Attest:*

GERALD J. MOSSINGHOFF

*Attesting Officer*

*Commissioner of Patents and Trademarks*